United States Patent [19]

Yoshida

[11] Patent Number: 4,866,744

[45] Date of Patent: Sep. 12, 1989

[54] SCATTERING BEAM ELIMINATING DEVICE FOR X-RAY CT APPARATUS

[75] Inventor: Tadatoki Yoshida, Ootawara, Japan

[73] Assignee: Kabushiki Kaisha Toshiba, Kawasaki, Japan

[21] Appl. No.: 243,111

[22] Filed: Sep. 6, 1988

Related U.S. Application Data

[63] Continuation of Ser. No. 904,645, Sep. 8, 1986, abandoned.

[30] Foreign Application Priority Data

Sep. 11, 1985 [JP] Japan ..... 60-199521

[51] Int. Cl.[4] ..... G21R 1/02

[52] U.S. Cl. ..... 378/7; 378/19; 378/149

[58] Field of Search ..... 378/7, 154, 19, 147, 378/149; 250/363.10

[56] References Cited

U.S. PATENT DOCUMENTS

| | | | |
|---|---|---|---|
| 4,057,725 | 11/1977 | Wagner | 378/7 |
| 4,096,389 | 6/1978 | Ashe et al. | 378/7 |
| 4,114,041 | 9/1978 | Oliver | 378/7 |
| 4,286,156 | 8/1981 | Wagner | 378/7 |

*Primary Examiner*—Carolyn E. Fields
*Assistant Examiner*—David P. Porta
*Attorney, Agent, or Firm*—Finnegan, Henderson, Farabow, Garrett & Dunner

[57] ABSTRACT

A scattering beam eliminating member is located between an X-ray tube and an X-ray gas detector such that it is intimately bonded to the window of the X-ray detector. The scattering beam eliminating member is of such a type that plates and X-ray transmission areas are alternately arranged in a slice direction to permit any scattering beam to be absorbed in the slice direction and never to be incident to the X-ray detector.

6 Claims, 3 Drawing Sheets

FIG. 4
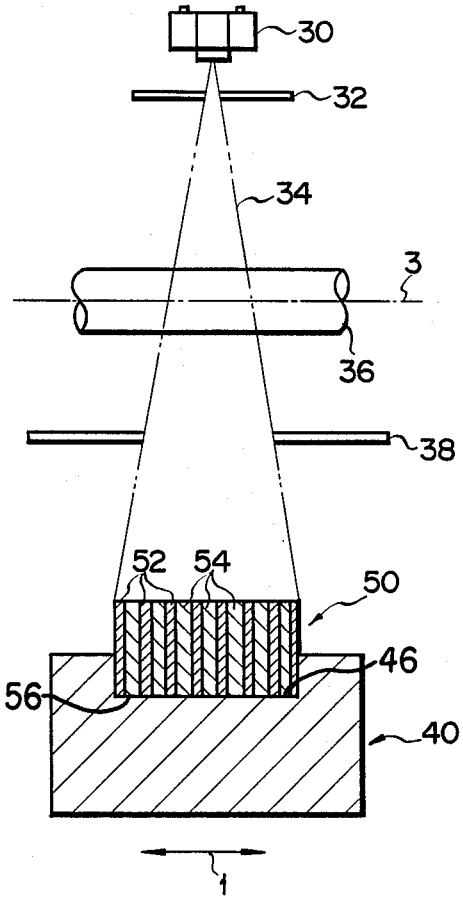
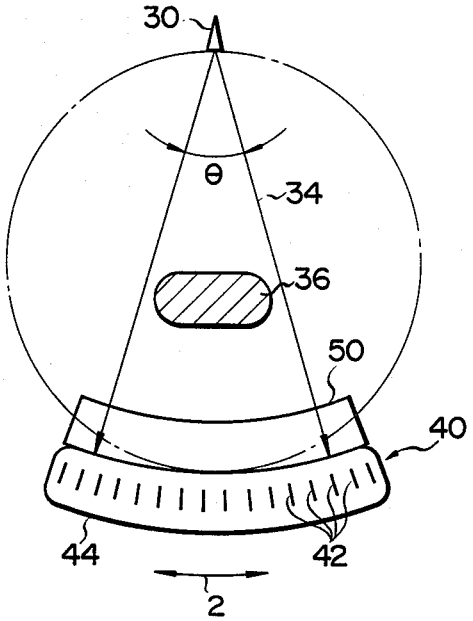
FIG. 5

SCATTERING BEAM ELIMINATING DEVICE FOR X-RAY CT APPARATUS

BACKGROUND OF THE INVENTION

This invention relates to a device for an X-ray CT apparatus, which eliminates a scattering beam in the slice direction of an X-ray.

In an X-ray CT apparatus, X-ray beam 12 from X-ray source 10 is formed through collimators 14 into a fan-shaped pattern, as shown in FIG. 1. The fan-shaped X-ray beam 12 has a proper circumferential length in fan-out direction 2 and a somewhat small width in slice direction 1. On the optical path of X-ray beam 12, a patient, not shown, lies on a bed and an X-ray passed through the patient enters into, for example, arcuate X-ray gas detector 16. X-ray gas detector 16 is curved in fan-out direction 2 with X-ray source 10 as a center. A high pressure xenon gas is sealed into X-ray detector 16 and plate-like electrodes, not shown, are arranged at a proper interval along fan-out direction 2 such that they are located in a substantially parallel fashion. Upon the entry of the X-ray into an area between the adjacent electrodes, a xenon gas is ionized to yield Xe ions and electrons. The Xe ions and electrons are detected by the corresponding electrodes as an ion current so that an amount of X-ray entering into the area between the respective electrodes is converted to an electric signal. In the X-ray CT apparatus, X-ray source 10 and X-ray detector 16 are rotated around a rotation axis which passes through the patient and is parallel to slice direction 1. Signals are produced in accordance with the amounts of X-ray during the rotation of X-ray source 10 and X-ray detector 16 and processed through computation to obtain a patient's slice image.

In such an X-ray CT apparatus, the X-ray from X-ray source 10 penetrates the patient and enters directly into detector 16. In addition to the X-ray beam, a scattering beam is also produced. Due to the scattering beam an error is introduced into the X-ray detection signal, impeding the formation of an exact image.

In fan-out direction 2, since the parallel electrodes of X-ray detector 16 function as a grid, the incidence of the scattering beam is suppressed to such an extent that it can practically be disregarded. In slice direction 1, however, the scattering beam is incident to gas detector 16 without being eliminated. In the prior art, no countermeasure has been taken so as to eliminate such a scattering beam in the slice direction. This is because, in the slice direction, an X-ray incident to X-ray detector 16 is one which has almost totally been transmitted through the patient, and less of the scattering beam is incident thereto. Recently, there is a tendency for the slice width of the X-ray to be decreased in order to improve spatial resolution in an X-ray CT image. However, a problem arises due to an increase in the penumbra area of the X-ray and in the amount of incident scattering beam.

FIGS. 2 and 3 are views each showing a relation between the X-ray beam in the slice direction and the area to which the X-ray beam is incident. In the prior art, since, as shown in FIG. 2, diaphragms 14 are located with a broader spacing therebetween and since X-ray beam 12 illuminated from the focus of X-ray source 10 has a broader width as a slice width S (the width taken in the slice direction of X-ray 12 at the position of the patient), penumbra area 24 is narrowed so that less dosage of X-ray is incident to X-ray detector 16. As shown in FIG. 3, however, if the slice width S of X-ray 12 is narrowed by an upper collimator, penumbra area 24 is increased and, for this reason, a greater amount of scattering beam 26 coming from the patient is incident to X-ray detector 16, thus degrading the resultant image.

In this way, if the slice width of the X-ray is narrowed so as to enhance the spatial resolution, an image degradation problem arises due to the scattering beam, thus prominently reducing the spatial resolution enhancement effect.

SUMMARY OF THE INVENTION

It is accordingly the object of this invention to provide a scattering beam eliminating device for an X-ray CT apparatus, which effectively eliminates the scattering component of an X-ray beam in the slice direction to improve both the spatial resolution and image accuracy.

According to this invention there is provided a scattering beam eliminating device for an X-ray CT apparatus including an X-ray irradiation device for irradiating a fan-shaped X-ray beam to a patient, the fan-shaped X-ray beam having an X-ray illumination area defined in a fan-out direction and slice direction, and an X-ray detector having an X-ray entrance surface and X-ray detection elements arranged in the fan-out direction to detect the X-ray incident thereto through the X-ray entrance surface, the detector detecting the X-ray which has penetrated the patient. The scattering beam eliminating device has a scattering beam eliminating member comprising an array of plate-like grids made of an X-ray-absorbing material and arranged substantially parallel to each other, a plurality of X-ray transmission areas each located between the grids and made of an X-ray transmitting material, and an X-ray exit surface positioned on the X-ray entrance surface and fixed to the X-ray entrance surface.

According to this invention, since the scattering portion of an X-ray which is produced in the slice direction is absorbed by the grid of the scattering beam eliminating member, the incidence of the scattering beam to the X-ray detector in the slice direction is suppressed. The scattering of the X-ray in the fan-out direction is suppressed under the action of the grid of the X-ray detector per se. Since the X-ray detector is not affected by the scattering beam in both the fan-out direction and the slice direction, the amount of X-ray transmitted is detected with high accuracy. It is, therefore, possible to obtain an image of high accuracy and an improved spatial resolution.

BRIEF DESCRIPTION OF THE DRAWINGS

FIG. 4 is a view showing an X-ray CT apparatus into which a scattering beam eliminating device according to an embodiment of this invention is incorporated;

FIG. 5 is a view showing an area irradiated with a fan-shaped X-ray beam pattern;

DETAILED DESCRIPTION OF THE PREFERRED EMBODIMENT

Figure 1:
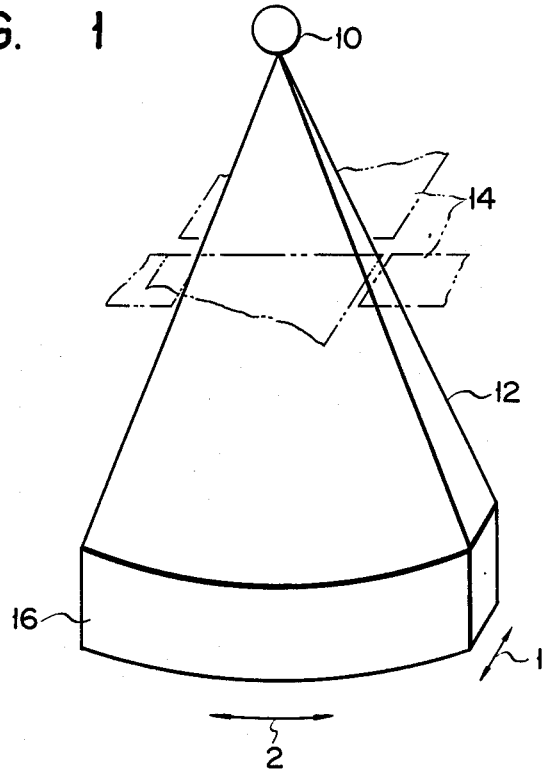
FIG. 1 is a view showing a fan-shaped beam pattern in the slice direction of a patient.
Figure 2:
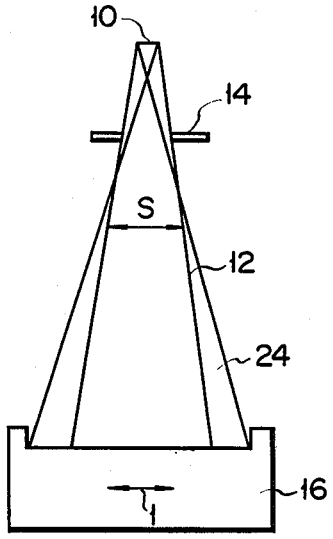
FIGS. 2 and 3, each, show a relation between an X-ray beam irradiation area in the slice direction and an X-ray detector.

As shown in FIG. 4, X-ray beam 34 emitted from X-ray tube 30 has its opposite edges defined by upper and lower collimators 32 and 38, respectively, to provide a fan-shaped beam pattern having a somewhat small width in slice direction 1 as indicated by dash-dot lines. X-ray beam 34 is input to X-ray detector 40 where the intensity of the X-ray beam is converted to an electric signal. Between X-ray tube 30 and X-ray detector 40 a bed, not shown, is located which extends in slice direction 1 and on which patient 36 lies. X-ray tube 30 and X-ray detector 40 are each located opposite to the patient such that they are rotated around rotation axis 3 with the patient as a center, noting that the rotation axis through the patient is parallel to the slice direction.

Figure 6:
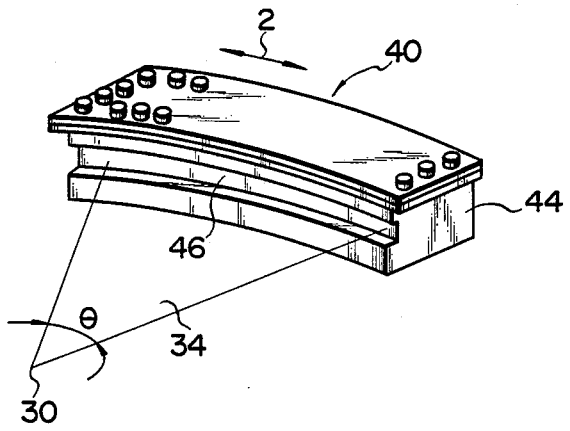
FIG. 6 is a perspective view showing an X-ray detector as used in the embodiment of this invention.
Figure 7:
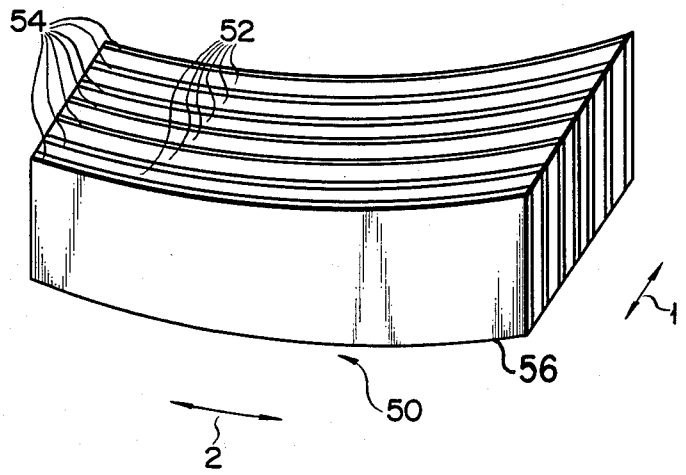
FIG. 7 is a perspective view showing a scattering beam eliminating device.

In X-ray detector 40, as shown in FIGS. 5 and 6, plate-like electrodes 42 are arranged, as an array of detection elements, in a parallel fashion, such that they are located in a direction substantially parallel to slice direction 1 and rotation axis 3. Electrodes 42 are disposed in closed housing 44 where, for example, an xenon gas is sealed. Upon the entry of an X-ray into an area between the adjacent electrodes, the xenon gas is ionized to yield xenon ions and electrons. The resultant ion current is detected by the electrodes where the incident X-ray is converted to an electric signal. Window 46 is provided on an X-ray entrance surface of detector 40 and is arcuately curved in fan-out direction 2 with the focus of X-ray tube 30 at its center.

The detection signals of X-ray detector 40, after having been converted to a digital signal, are input to an image processing device, not shown, to reconstruct a tomographic image This reconstruction may be implemented by a known method. This method is disclosed, for example, in U.S. Pat. Nos. 4,206,359, 4,212,062 or 4,219,876.

Scattering beam eliminating member 50 is comprised of plate-like grids 52 and X-ray transmission (penetrating) areas 54, each of which is located between the grids. Grids 52 are made of an X-ray absorbing metal, i.e., X-ray transmission inhibiting metal, such as lead, molybdenum or tungsten X-ray transmission areas 54, on the other hand, are made of an X-ray transmitting metal, such as aluminum.

Scattering beam eliminating member 50 can be formed as follows:

For example, lead and aluminum plates are stacked as a 20- to 30-layered structure and mutually bonded to provide a block. In order for the respective plates to be arcuately curved in the width direction with the focus of X-ray tube 30 at its center, the aforementioned block is bent such that the outer arcuate surface 56 is formed with the same curvature as that of window 46 of X-ray detector 40. Scattering beam eliminating member 50 is fixedly bonded to X-ray detector 40 with the outer arcuate surface face 56 placed in intimate contact with window 46 of X-ray detector 40. In this way, the X-ray exit surface (outer arcuate surface 56) of scattering beam eliminating member 50 is curved with substantially the same curvature as that of window 46 (X-ray entrance surface) of X-ray detector 40 and bonded to window 46 of X-ray detector 40 to provide an integral structure. As a result, no displacement due to, for example, oscillation, occurs at that bonded area, whereby it is possible to prevent a variation in sensitivity characteristics at the respective cell of X-ray detector 40, energy characteristics or channel characteristics such as linearity. Scattering beam eliminating member 50 is, for example, 2 to 3 mm in height in the X-ray irradiation direction, 20 to 30 mm in width in slice direction 1 and 600 to 1000 mm in length in fan-out direction 2. Grids 52 are 30 to 80 μm each in thickness and arranged at a pitch of 100 to 200 μm which is a thickness of the X-ray transmission area 54.

The operation of the device so arranged will be described below.

Figure 3:
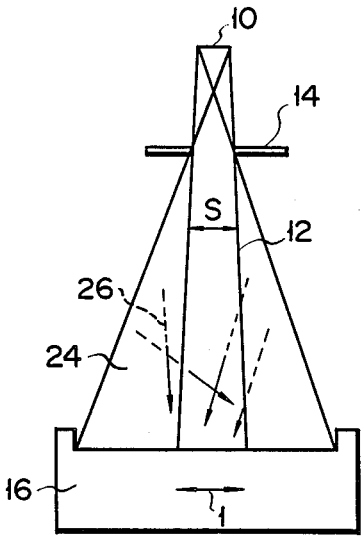

X-ray 34 from X-ray tube 30 is narrowed through upper collimator 32 to a predetermined width (slice width S) and irradiated onto patient 36. The direct component of the X-ray beam transmitted through patient 36 passes through X-ray transmission areas 54 between grids 52 into X-ray detector 40. However, a scattering beam portion (see scattering beam 26 in FIG. 3) produced in slice direction 1 of X-ray beam 34 at the location of patient 36 impinges onto grids 52 and is absorbed there, since the scattering beam portion is never parallel to grids 52, so that it cannot therefore enter into X-ray detector 40 through grids 52. For this reason, even if the slice width S of X-ray 34 is adequately narrowed the amount of scattering beam incident to X-ray detector 40 will not be increased. The tomographic image of patient 36 which has been reconstructed based on transmission X-ray information so detected by X-ray detector 40 is free from any influence from the scattering beam, thus adequately improving a spatial resolution. It is therefore possible to obtain an image very useful for medical diagnosis.

In this embodiment, grids 52 are arranged in only slice direction 1, not in fan-out direction 2, the reason for which is as follows.

In fan-out direction 2, the channel spacing of X-ray detector 40 is about 1 mm and, according to the current grid array technique, it is possible to insert about 50 plate-like grids for that spacing of 1 mm. If one of the plate-like grids is missing in any one of a plurality of channels of X-ray detector 40, then a variation of 1/50 (2%) in uniformity occurs among all the channels. In the so-called third generation X-ray CT apparatus, a interchannel uniformity of below 0.05 to 0.2% is required and thus a variation of 2% fails to satisfy the aforementioned requirement. The presence of such a defect necessarily produces an artifact on the image. In the slice direction, on the other hand, the beam width on the X-ray entrance surface of the X-ray detector for a slice width of 10 mm is about 20 mm within which about 1000 plate-like grids are arranged. In this case, a variation in the aforementioned uniformity corresponding to one plate-like grid is 0.1%, an allowable value range. A plurality of grids is adequately implementable only in the slice direction without impairing the interchannel uniformity. This offers an effective means for enhancing a spatial resolution on the image.

Needless to say, this invention can also be applied to a solid-state X-ray detector, not to mention a gas detector. In an X-ray CT apparatus employing such a solid-state X-ray detector an array of scintillation elements are located in a fan-out direction and a collimator plate made of a material which permits no ready transmission of an X-ray is located between the respective scintillation elements. The X-ray penetrating the patient is converged by the collimator plates and incident to the scintillation elements. Upon the incidence of the X-ray to the scintillation element, light is induced and converted to an electric signal by a corresponding diode in an array of photodiodes. The scattering beam eliminating device of this invention can be intimately bonded to the X-ray entrance surface of the solid-state detector, whereby it is possible to eliminate the scattering beam.

What is claim is:

1. A scattering beam eliminating device for an X-ray CT apparatus including X-ray irradiation means for irradiating a fan-shaped X-ray beam to a patient, the fan-shaped X-ray beam having an X-ray illumination area defined in a fan-out direction and a slice direction, and an X-ray detector having an X-ray entrance surface and X-ray detection elements arranged in the fan-out direction to detect the X-ray incident thereto through the X-ray entrance surface, the detector detecting the X-ray which has penetrated the patient, the scattering beam eliminating device comprising:

(A) a scattering beam eliminating member having an X-ray exit surface positioned on the X-ray entrance surface of the X-ray detector and fixed to the X-ray entrance surface, the scattering beam eliminating member including: (i) an array of substantially parallel plates made of an X-ray absorbing material and spaced apart in the slice direction; and (ii) a plurality of X-ray transmission areas, each located in the space between an adjacent pair of said plates and made of an X-ray transmitting material, and (B) a collimator disposed between said X-ray illumination means and said scattering beam eliminating member for defining an X-ray illumination area in a fan-out direction and a slice direction.

2. A scattering beam eliminating device according to claim 1, in which the X-ray entrance surface of the X-ray detector and said X-ray exit surface of said scattering beam eliminating member are curved in the fan-out direction and have substantially the same curvature.

3. A scattering beam eliminating device according to claim 1, in which said plates are made of a metal selected from the group consisting of lead, molybdenum and tungsten.

4. A scattering beam eliminating device according to claim 1, in which said X-ray transmission areas are made of aluminum.

5. A scattering beam eliminating device according to claim 1, in which each of said plates is 30 to 80 $\mu$m in thickness and said plates are spaced apart with a pitch of 100 to 200 $\mu$m.

6. An X-ray CT apparatus comprising:

X-ray irradiation means for irradiating a fan-shaped X-ray beam to a patient, the fan-shaped X-ray beam having an X-ray illumination area defined in a fan-out direction and a slice direction;

an X-ray detector, having an X-ray entrance surface, including substantially parallel plate-like X-ray detection elements for detecting X-ray radiation incident thereon said X-ray detection elements being spaced apart in said fan-out direction;

a scattering beam eliminating member having an X-ray exit surface positioned on the X-ray entrance surface of the X-ray detector and fixed to the X-ray entrance surface, the scattering beam eliminating member including an array of substantially parallel, plates made of an X-ray absorbing material, spaced apart in the slice direction, and a plurality of X-ray transmission areas located in the space between an adjacent pair of said plates, said plurality of X-ray transmission areas being made of an X-ray transmitting material.

* * * * *